US010802426B2

(12) United States Patent
Park et al.

(10) Patent No.: US 10,802,426 B2
(45) Date of Patent: Oct. 13, 2020

(54) FUSING DEVICE AND IMAGE FORMING APPARATUS HAVING THE SAME

(71) Applicant: HEWLETT-PACKARD DEVELOPMENT COMPANY, L.P., Spring, TX (US)

(72) Inventors: Jinho Park, Suwon (KR); JeHwan You, Suwon (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/393,481

(22) Filed: Apr. 24, 2019

(65) Prior Publication Data

US 2019/0250541 A1 Aug. 15, 2019

Related U.S. Application Data

(63) Continuation of application No. PCT/KR2017/002473, filed on Mar. 7, 2017.

(30) Foreign Application Priority Data

Oct. 24, 2016 (KR) ..... 10-2016-0138251

(51) Int. Cl.
*G03G 15/20* (2006.01)
*G03G 21/16* (2006.01)

(52) U.S. Cl.
CPC ..... *G03G 15/2028* (2013.01); *G03G 15/2064* (2013.01); *G03G 21/1647* (2013.01); *G03G 2221/1657* (2013.01)

(58) Field of Classification Search
CPC ..... G03G 15/2028; G03G 15/2064; G03G 21/1647; G03G 2221/1657
See application file for complete search history.

(56) References Cited

U.S. PATENT DOCUMENTS

2003/0190175 A1* 10/2003 Pitts ..... G03G 15/2028 399/322
2007/0217839 A1* 9/2007 Moteki ..... G03G 15/2028 399/329
2008/0179823 A1 7/2008 Yuzawa
2010/0061741 A1* 3/2010 Minbu ..... G03G 15/657 399/21
2012/0161385 A1 6/2012 Haruyama
(Continued)

*Primary Examiner* — Clayton E. LaBalle
*Assistant Examiner* — Michael A Harrison
(74) *Attorney, Agent, or Firm* — Staas & Halsey LLP

(57) ABSTRACT

A fusing device including a heating member, a pressing member to press a recording medium while facing the heating member, a first guide member to guide the recording medium to a nip formed between the heating member and the pressing member, a second guide member to be hingeably connected to the first guide member, the second guide member to move to a first position and to a second position, and an actuator configured to move the second guide member to the first position and the second position, the second guide member being further away from the heating member at the second position than at the first position, and the second guide member is to move to the first position before a front end of the recording medium enters the nip, and is to move to the second position after the front end of the recording medium enters the nip.

15 Claims, 12 Drawing Sheets

(56) References Cited

U.S. PATENT DOCUMENTS

| | | | | |
|---|---|---|---|---|
| 2013/0004222 | A1* | 1/2013 | Sakaya | B65H 5/062<br>399/400 |
| 2014/0133872 | A1 | 5/2014 | Kang | |
| 2016/0170341 | A1 | 6/2016 | Onishi | |
| 2016/0291515 | A1 | 10/2016 | Koyama | |

* cited by examiner

FUSING DEVICE AND IMAGE FORMING APPARATUS HAVING THE SAME

CROSS-REFERENCE TO RELATED APPLICATION

This application is a continuation application of International Patent Application No.: PCT/KR2017/002473, filed on Mar. 7, 2017, which claims the benefit of Korean Patent Application number 10-2016-0138251, filed on Oct. 24, 2016, in the Korean Intellectual Property Office, and the disclosure of which is incorporated by reference herein in its entirety.

BACKGROUND

In general, an image forming apparatus such as a printer, a copy machine, a multifunction printer which use electrophotography includes a fusing device for semi-permanently fusing an image transferred onto a recording medium by a transfer device by applying heat and pressure. The fusing device includes a roller-type fusing device having a pressing roller with a heat source installed therein and a pressing roller which is welded to the heating roller and forms a nip, and a belt-type fusing device using a fusing belt. The temperature rising speed for fusing of the belt-type fusing device is faster than that of the roller-type fusing device.

In such a related-art fusing device, a conveying force for conveying paper is not constant, depending on the size of the paper. Accordingly, when the paper enters the nip, the left or right side of the front end of the paper is first entered into the nip, thereby generating a time difference of entering the nip along a width direction of the paper. The time difference causes wrinkles on the paper in the width and length directions.

In particular, when the size of the paper is small, when the front end of the paper enters the nip, the rear end of the paper has already passed through a registration part or a transfer part, and the conveying force is not obtained, and the contact area in which the paper is in contact with the convey belt is reduced, and accordingly, the conveying force is reduced. Therefore, when the front end of the paper enters the nip, if the distance between the front end of the paper and the heating roller is not adjusted, the paper does not enter the nip well, or feeding failure such as crumpling or wrinkles of paper occurs on the paper.

In the related-art fusing device, even after the front end of the paper has entered the nip, the paper moves in a state adjacent to the heating roller. In this case, the unfused toner transferred to a portion of the paper before entering the nip flows by the high-temperature heat emitted from the heating roller. As a result, the unfused toner is spread over the paper, thereby generating smear to an image.

DETAILED DESCRIPTION

Figure 1:
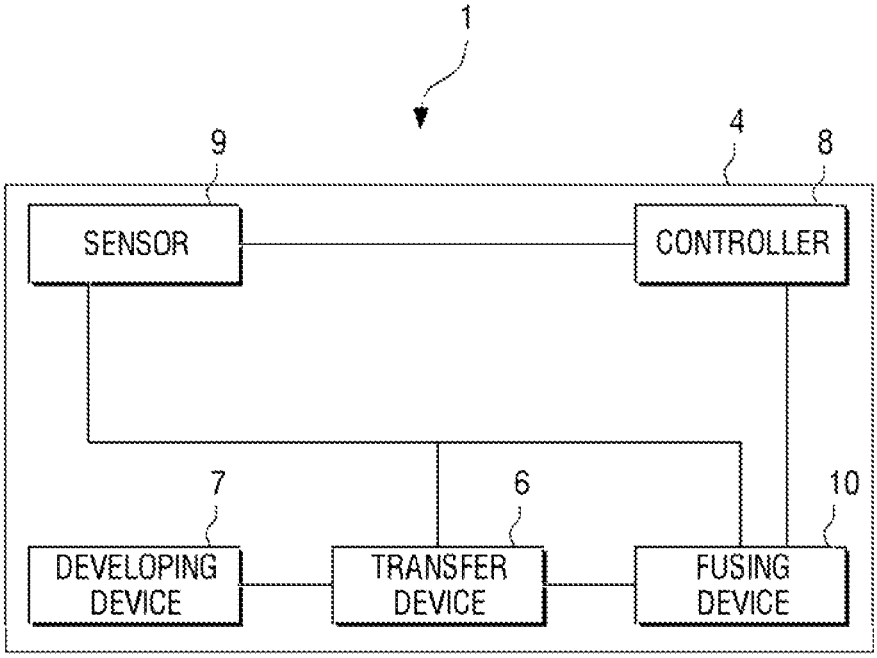
FIG. 1 is a conceptual diagram briefly illustrating an image forming apparatus including a fusing device according to an example of the disclosure.

Hereinafter, various examples of the disclosure will be described in detail with reference to the accompanying drawings. It will be understood, however, that it is not intended to limit the techniques described herein to examples, but may include various modifications and equivalents of the examples of the techniques described herein. In the context of the description of the drawings, identical, similar reference numerals may be used for like and similar elements.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein. In some cases, the terms defined herein may not be construed to exclude examples of the disclosure.

It has been described that the image forming apparatus 1 according to an example of the disclosure is applied to a printer, but is not limited thereto, and applied to various types of image forming apparatuses such as a fax machine, a copy machine, and a multifunction printer, or the like.

FIG. 1 is a conceptual diagram briefly illustrating an image forming apparatus 1 including a fusing device 10 according to an example of the disclosure.

As illustrated in FIG. 1, the image forming apparatus 1 includes a developing device 7, a transfer device 6, and the fusing device 10. The developing device 7 forms an electrostatic latent image on a photosensitive medium (not shown) to induce a developing agent to be attached to a surface of the photosensitive medium. The developing agent thus formed on the surface of the photosensitive medium is transferred as an image on one side of a recording medium (hereinafter referred to as "paper") by the transfer device. The developing agent transferred onto the paper is fused onto the paper by heat, while passing through the fusing device 10.

The image forming apparatus 1 includes a fusing device which is capable of preventing wrinkles and image smear from being generated onto paper in a process of fusing the developing agent on the paper. Hereinbelow, a configuration of the fusing device 10 will be described in further details with reference to FIGS. 2 to 5, according to an example of the disclosure.

Figure 2:
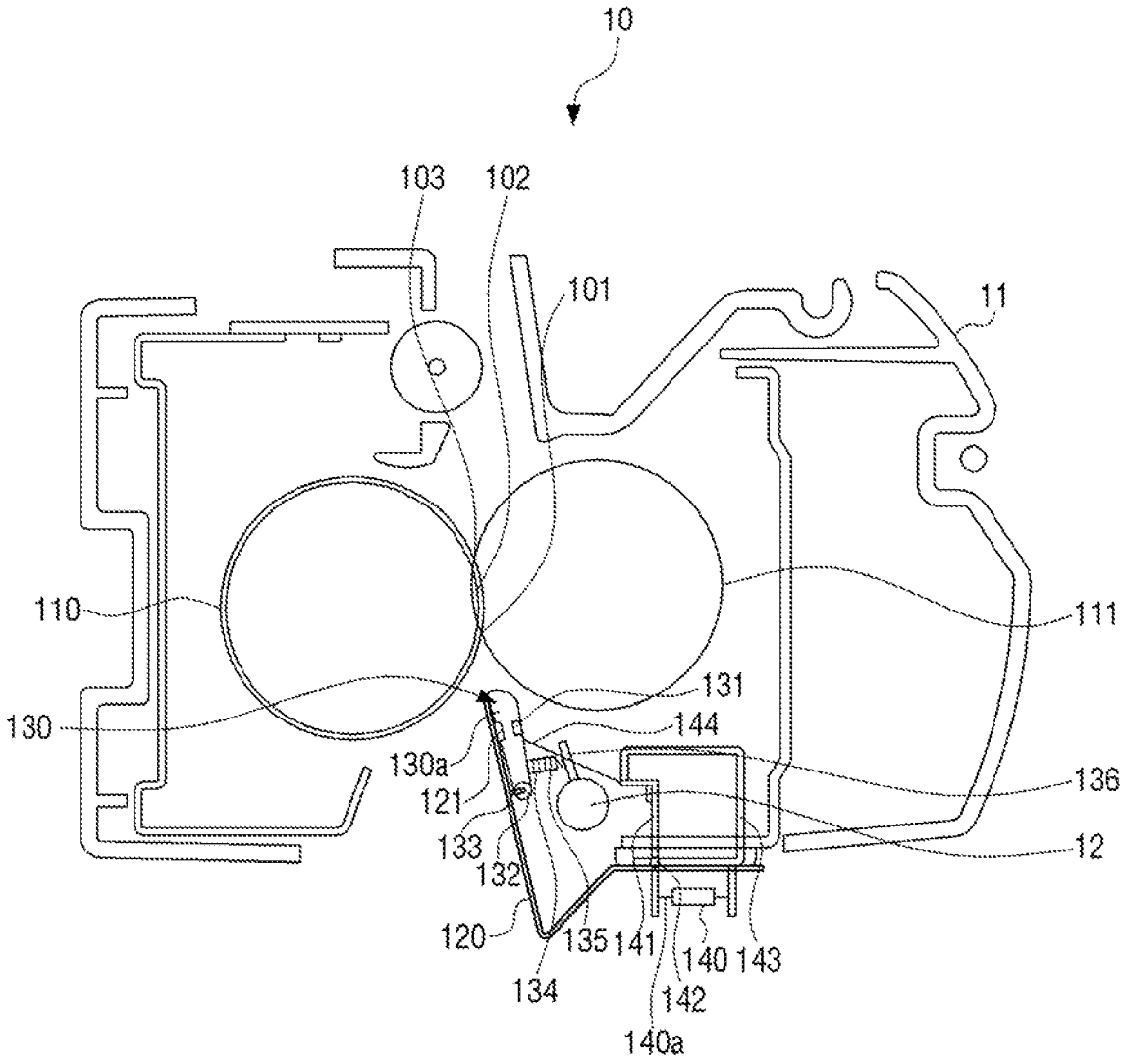
FIG. 2 is a sectional view illustrating a fusing device according to an example of the disclosure.

FIG. 2 is a sectional view illustrating the fusing device 10 according to an example of the disclosure, FIG. 3 is a sectional view illustrating an operating state of a fusing device an example of the disclosure, FIG. 4 is a view enlarging IV part of FIG. 3, FIG. 5 is a partial perspective view illustrating a state in which the second guide member operates in the front end of the first guide member according to an example of the disclosure.

Referring to FIG. 2, the fusing device 10 according to an example of the disclosure includes a heating member 110, a pressing member 111 which presses paper while facing the heating member, a first guide member 120 and a second guide member 130 for guiding paper to a nip 102 formed between the heating member 110 and the pressing member 111.

As shown in FIGS. 2 and 3, the pressing member 111 is arranged to face the heating member 110, and rotates while pressing the heating member 110. The heating member 110 rotates in the direction opposite to the direction in which the pressing member 111 rotates due to the frictional force with the rotating pressing member 111. In this case, the heating member 110 may receive power from a separate driver (not shown) and rotate.

The front end of the first guide member 120 is disposed with an interval at a nip entrance 101 so that the front end of the fed paper 2 faces the nip 102.

As described above, the reason why the front end of the first guide member 120 is disposed adjacent to the nip entrance 101 is that the conveying force for conveying the paper according to the size of the paper is not constant.

When the paper 2 is small, while the rear end of the paper passes through a registration device (not shown) or the transfer device 6, it is difficult to obtain conveying force due to rotation of the registration roller (not shown) or the transfer roller (not shown), and when the paper 2 enters the nip, the left or right side of the front end of the paper first enters the nip, and a time difference occurs in entering the nip along the width direction of the paper.

By the time difference, wrinkles are generated in a width direction and a length direction of the paper.

Therefore, even when the paper 2 is small and it is difficult to obtain the conveying force, in order to prevent wrinkles from occurring on the paper while passing through the fusing device 10 and prevent feeding failure from occurring, when the front end of the paper enters the nip entrance 101, the first and second guide members 120 and 130 need to be positioned so that the front end of the paper may be brought into close contact in the tangential direction of the circumferential surface of the heating roller.

Accordingly, the first guide member 120 may be disposed as close as possible to the nip entrance 101 so that the paper 2 to which the developer is transferred enters the nip entrance 101 and the wrinkles do not occur on the paper.

When the first guide member is disposed too close to the nip entrance 101 or the heating member 110, the paper 2 guided by the first guide member 120 is affected from heat emitted from the heating member 110. Accordingly, since the developer which is unfused on the paper is melted by the heat generated by the heating member 110 and image smear is generated. Thus, the paper 2 may be guided to be spaced apart from the heating member 110 to some degree.

The second guide member 130 is rotatably disposed on the first guide member 120 in clockwise and counterclockwise directions. To this end, the rear end 132 of the second guide member is hingeably connected to the connection portion 133 extensively formed on the first guide member 120.

Figure 3A:
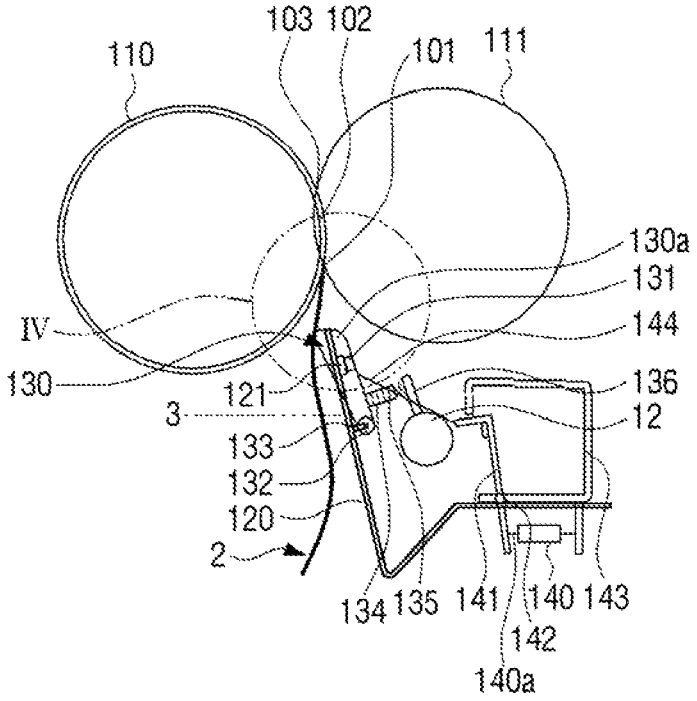
FIGS. 3A and 3B are sectional views illustrating an operating state of a fusing device according to an example of the disclosure.

As FIG. 3A, when the paper 2 enters the nip entrance 101, the second guide member 130 rotates in a direction to be closer to the heating member 110, and guides the paper 2 to be as close as possible to the tangential direction of the heating member 110.

Figure 3B:
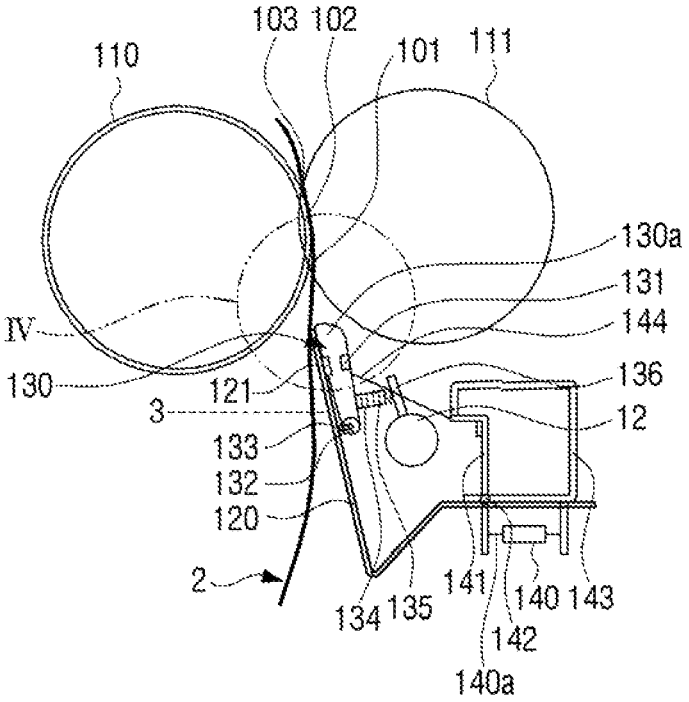

As illustrated in FIG. 3B, the second guide member 130 rotates in a direction to move away from the heating member 110 when the front end of the paper 2 passes through the nip entrance 101, and guides the paper 2 to move away from the heating member 110 as far as possible. Here, the position where the second guide member 130 is as close as possible to the heating member 110 is defined as a first position, and the position where the second guide member 130 moves away as far as possible from the heating member 110 is defined as the second position.

The second guide member 130, while rotating between the first position and the second position, causes the front end of the paper to be close to the tangential direction of the heating member 110 not to generate wrinkles on the paper 2 entering the nip entrance 101. After the front end of the paper passes through the nip entrance 101, the paper 2 is disposed to move far away from the heating member 110 in order to prevent the image smear on the paper 2 from occurring due to the unfused developing agent.

Referring to FIG. 5, the second guide member 130 may include a plurality of ribs 130*a* passing through a plurality of grooves 120*a* formed on the front end of the first guide member 120.

Figure 4A:
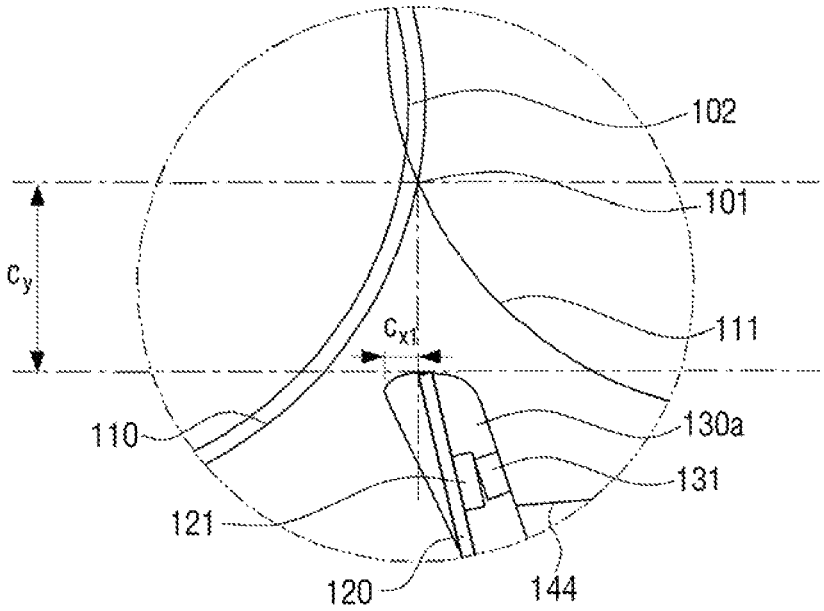
FIGS. 4A and 4B are views enlarging IV part of FIGS. 3A and 3B.

Referring to FIG. 4A, the maximum horizontal displacement value at the first position which is the position where the front end of the rib 130*a* is as close as possible to the heating member 110 may be defined as $Cx_1$, and the minimum vertical displacement value which the nip entrance 101 and the front end of the first guide member 120 may form may be defined as Cy. In this case, the value of $Cx_1$ may be limited to $0<Cx_1<2$ mm. The Cy value may be limited to 2 mm<Cy<14 mm.

Referring to FIG. 5, a plurality of grooves 120*a* are formed at the front end of the first guide member 120 so that the ribs 130*a* protrude toward the heating member 110, and when the ribs 130*a* passing through the plurality of grooves 120*a* protrude, the paper 2 is disposed closer to the heating member 110.

The plurality of ribs 130*a* may be formed to be parallel to each other at regular intervals in the width direction of the paper 2 and the surfaces of the plurality of ribs 130*a* contacting the paper 2 may have a smooth surface to reduce frictional resistance as much as possible.

Further, the plurality of ribs 130*a* may form a gentle slope or a curved portion at a portion contacting the paper to smoothly guide the paper 2.

The plurality of grooves 120*a* formed at the front end of the first guide member 120 may be formed in a shape similar to a comb. In this case, each of the ribs 130*a* has a width smaller than the width of each groove 120*a* to pass through each groove 120*a*.

As the plurality of grooves 120*a* are formed in a comb shape, the plurality of ribs 130 are arranged at predetermined intervals from each other in the width direction as much as the intervals between each groove 120*a*, to minimize a contact area of the plurality of ribs 130*a* contacting the paper 2, which will result in reducing frictional resistance to smooth feeding of the paper.

Figure 4B:
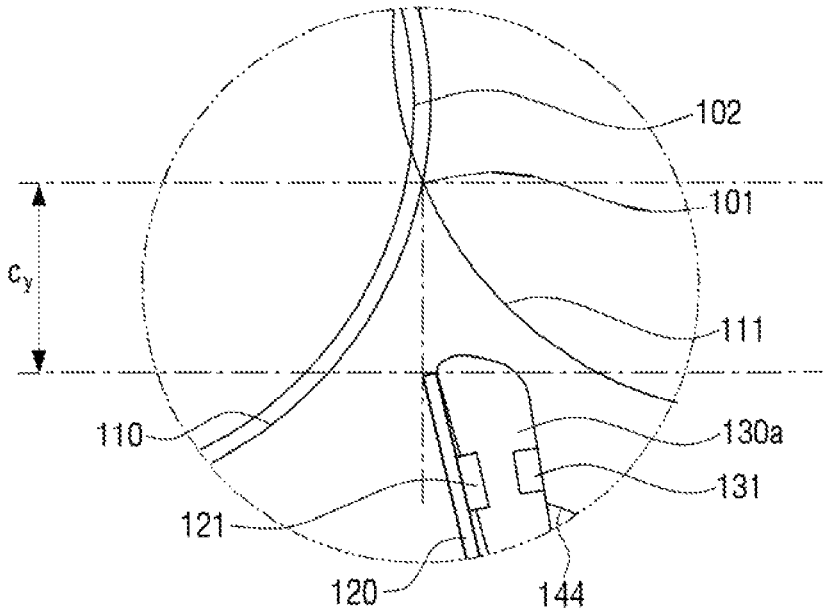

Referring to FIGS. 3B and 4B, when the second guide member 130 moves from the first position to the second position, the first guide member 120 guides the paper 2 to the nip 102 instead of the second guide member 130. Accordingly, when the paper 2 is guided by the first guide member 120, the front end of the first guide member 120 may be disposed at a position where image smear on the paper may be prevented.

If the front end of the first guide member 120 is disposed closer to the heating member 110 than the first position, when the second guide member 130 rotates and moves to the first position, the distance with the heating member 110 becomes excessively closer and the image smear becomes very serious. Even if the second guide member 130 is moved to the second position, the front end of the first guide member 120 still maintains a state to be close to the heating member 110, so that image smear may not be prevented.

Therefore the front end of the first guide member 120 may be disposed between the first position and the second position to which the second guide member 130 moves, to prevent the image smear.

Also when the front end of the first guide member 120 moves farther away from the heating member 110 than the second position, the second guide member 130 rotates and moves to the first position, and the second guide member 130 is positioned to be comparatively far away from the heating member 110.

In this case, when the front end of the paper enters the nip entrance 101, the front end becomes farther away from the tangential direction of the heating member 110, the left or right side of the front end of the paper first enters the nip, the paper is in contact with the nip, and a time difference occurs in terms of the contact of the paper in the width direction. If this time difference is not minimized, wrinkles will occur in the width direction of the paper.

If the second guide member 130 is excessively close to the heating member 110, image smear may occur on the paper excessively, and a stopper 121, 131 may be formed on at least one of the first and second guide members 120 and 130 and limit the rotation range of the second guide member 130.

Referring to FIG. 3A, the stopper 121 formed on the first guide member 120 may contact with the stopper 131 formed on the second guide member 130. The stopper 121 of the first guide member may limit the rotation angle of the second guide member 130 so that the second guide member 130 may not move excessively close to the heating member 110.

In order to prevent the second guide member 130 from moving excessively close to the heating member 110 which will cause image smear on the paper, the stoppers 121 and 131 may be formed on both of the first guide member 120 and the second guide member 130. The example of the disclosure is not limited thereto, and the stopper 121 may not be formed on the first guide member 120.

If the angle at which a lever 141 may be rotated is limited in accordance with the movable range of the solenoid 140 constituting the actuator to be described later, the rotation range of the second guide member 130 which is connected to the lever 141 by the connecting member 144 also has a limited range of rotation. Therefore, even when the stoppers 121 and 131 are not formed on the first and second guide members 120 and 130, the rotation scope of the second guide member 130 may be limited by the solenoid 140 and the lever 141.

Referring to FIG. 3A, the elastic member 135 may provide elastic force to the second guide member 130 in a direction from the second position toward the first position.

The elastic member 135 may be made of a coil spring. However, if the second guide member 130 can be pushed toward the first position, various types of springs which are capable of pushing the second guide member 130 to the first position such as a leaf spring, a torsion spring, and a rubber spring, and the like, may be used.

Also the second guide member 130 is formed with a protrusion 134 for mounting the coil spring 135. The length of the protrusion 134 is shorter than the length of the coil spring 135, and the coil spring 135 may protrude toward the second position so as to be mounted on the second guide member 130.

One end of the coil spring 135 is supported on one surface of the second guide member 130 and the other end of the coil spring 135 is supported on a fixed structure 136 formed on an inner frame 12 of the housing 11 of the image forming apparatus. The coil spring 135 may apply an elastic force to the second guide member 130 to push the second guide member 130 from the fixed structure 136 to the first position.

As described above, the coil spring 135 plays a role to move the second guide member 130 to the first position in cooperation with the lever 141, the connecting member 144, and the solenoid 140 included in the actuator to be described later.

Further, the fusing device according to one example of the disclosure includes an actuator capable of moving the second guide member 130 to the first and second positions. The actuator may include at least one lever 141, the connecting member 144 connecting one end of the lever 141 and the second guide member 130, and the solenoid 140 which may rotate the lever 141, as an operating portion 140*a* is connected to the other end of the lever 141.

Referring to FIG. 3, one end of the lever 141 is connected to the second guide member 130 by the connecting member 144 and the other end is connected to the operating portion 140*a* of the solenoid 140. In this case, the lever 141 is hingeably connected to the support frame 143 via the hinge element 142 at a substantially central portion.

The lever 141 may be provided with the number which is the same as the number of the plurality of ribs 130*a*, and it is possible to have at least one lever 141.

The lever 141 is configured so that one end may rotate in the direction in which the one end moves closer to the second guide member and moves away from the second guide member between the first and second positions.

The support frame 143 is fixed on the housing 11 of the image forming apparatus or the first guide member 120. A space is formed so that the solenoid 140 may be mounted on one portion of the support frame 143.

The solenoid 140 is installed so that one end is fixed to the support frame 143, and the operating portion 140*a* of the solenoid 140 is configured to be connected to the other end of the lever 141.

The solenoid 140 pulls or pushes the other end of the lever 141 through the operating portion 140*a*. Accordingly, one end of the lever 141 is rotated toward the first or second position with the hinge element 142 as a center axis.

In this example, when no power is supplied to the solenoid 140, the coil spring 135 may apply press over the rib 130*a* to move to the first position. In this case, the solenoid 140 may drive the other end of the lever 141 when moving the rib 130*a* to the second position. As a result, the power to be consumed by the solenoid 140 may be minimized.

The connecting member 144 for connecting the one end of the lever 141 and the second guide member 130 may be formed of a wire but any configuration which may connect the one end of the lever 141 to the second guide member 130, and transmit the rotational force of the lever 141 to the second guide member 130 may be used.

The fusing device 10 according to an example of the disclosure may include a sensor 9 for detecting the positions of the front end and the rear end of the paper entering the fusing device, and a controller 8 for controlling the configuration of the actuator according to the position of the detected position of the paper.

The sensor 9 may include a detecting sensor for detecting a position of paper generally used for an image forming apparatus.

The sensor 9 is disposed before and after the fusing device 10, is electrically connected to the controller 8, and transmits a position signal (paper-in signal and paper-out signal) of the paper to the controller 8.

Hereinbelow, with reference to FIGS. 1 to 5, a method for driving the second guide member 130 according to an example will be further described.

First, the sensor 9 which detects the front end and the rear end of paper detects whether the front end of paper passes through the transfer device 6 or reaches the position 3 before entering the nip entrance 101.

At this time, the sensor 9 transmits a paper-in signal to the controller 8. The controller 8 receiving the paper-in signal controls the actuator so as to be as close as possible to the tangential direction of the heating member 110 before the front end of the paper enters the nip entrance 101, and moves the second guide member 130 to the first position.

The controller 8 may be electrically connected to the solenoid 140 constituting the actuator, and the controller 8 receiving the paper-in signal controls so that the operating portion 140*a* of the solenoid 140 pulls the other end of the lever 141. Referring to FIG. 3A, the lever 141 rotates around the hinge element 142 hingeably connected to the support frame 143, and loosens tension applied to the connecting member 144 connected to the one end of the lever 141.

Subsequently, the plurality of ribs 130*a* are pressed toward the first position by the elastic force of the coil spring 135 and pass through the plurality of grooves 120*a* of the first guide member 120, thereby protruding to be adjacent to the heating member 110.

Figure 5A:
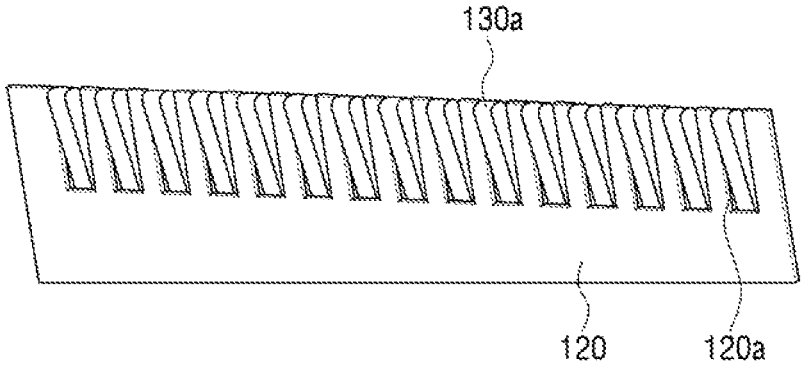
FIGS. 5A and 5B are partial perspective views illustrating a state in which the second guide member operates in the front end of the first guide member according to an example of the disclosure.

Referring to FIGS. 3A and 5A, the plurality of ribs 130*a* protrude to the first position, and the front end of the paper 2 is in contact with the plurality of ribs 130*a* prior to entering the nip entrance 101 and is guided to the tangential direction of the heating member 110 in a position to be adjacent to the heating member 110 as close as possible.

Accordingly, when the paper is in contact with the nip entrance 101, time difference of contacting the nip 102 in a width direction does not rarely occur, and thus, the phenomenon that wrinkles occur in the width and length directions of the paper may be prevented from occurring.

When the front end of the paper passes through the nip entrance 101 and then advances to the nip 102, the sensor 9 detects that the front end of the paper passes through the nip entrance 101 or reaches the nip 102, and transmits the fuser-in signal to the controller 8.

The controller 8 receiving the fuser-in signal controls the actuator to move the second guide member 130 to the second position, so that the central part of the paper in which the developing agent is transferred is spaced apart from the heating member 110 as much as possible.

The controller 8 is electrically connected to the solenoid 140 constituting the actuator.

Referring to FIG. 3B, the controller 8 receiving the fuser-in signal controls so that the solenoid 140 pushes the lever 141.

And, after the front end of the paper enters the nip entrance 101 or passes through the nip entrance, the controller 8 may control the solenoid 140 to push the lever 141 so that the second guide member 130 is moved to the second position. At this time, when the lever 141 is pushed by the operating portion 141*a* of the solenoid, the second guide member 130 moves away from the heating member 110 as the second guide member 130 is pulled by the connecting member 144 connected to the one end of the lever.

When the lever 141 is pulled over, the lever 141 rotates around the hinge element 142 which is hingeably connected to the support frame 143, and makes the connecting member 144 connected to the one end of the lever 141 tight.

The lever is pulled by the tightened connecting member 144 and the one side of the coil spring 135 mounted on the protrusion 134 of the rib 130*a* is compressed and contracted by the fixed structure 136, the rib 130*a* moves from the groove 120*a* formed at the front end of the first guide member 120 and moves away from the heating member 110.

Figure 5B:
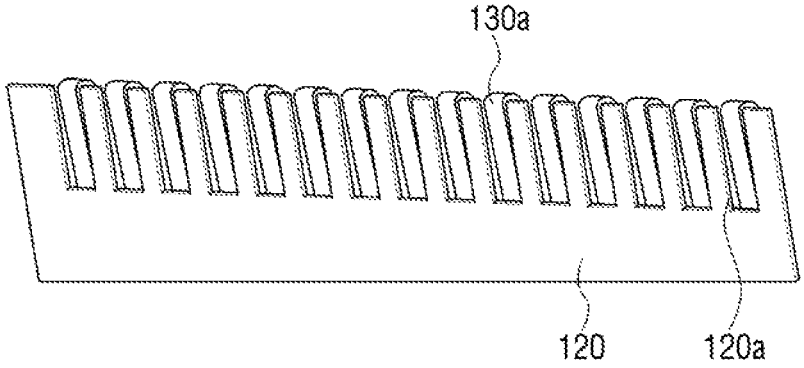

Referring to FIGS. 3B and 5B, the front end of the paper passes through the nip entrance 101, and then a plurality of ribs 130*a* move away from the heating member 110 to move to the second position, and the middle portion of the paper 2 moves away from the heating member 110 as much as possible when it is fed in contact with the front end of the first guide member 120.

As the middle part of the paper moves away from the heating member 11, the developer or toner not fused to the paper 2 is not melt by the heat generated by the heating member 110 and image smear is prevented.

And when the rear end of the paper passes through the nip 102 or a nip outlet 103, the sensor 9 detects this, and transmits a fuser-out signal to the controller 8.

At this time, the controller 8 which receives the fuser-out signal controls the solenoid 140 so as to induce another paper following the paper which passed in advance to be adjacent to the nip entrance 101.

The solenoid 140 pulls the lever 141 by the operating portion 140*a* so as to move the second guide member 130 to the first position, in order to allow the front end of the other paper to be as close as possible to the tangential direction of the heating member 110 before entering the nip entrance 101.

The pulled lever 141 rotates around the hinge element 142 which is hingeably connected to the support frame 143 and loosens the connecting member 144 connected to the one end of the lever 141.

When the connecting member 144 is loosened, the coil spring 135 mounted on the protrusion 134 of the rib 130*a* pushes out the fixed structure 136, and the rib 130*a* passes through the groove 120*a* formed at the front end of the first guide member 120 and protrudes back toward the heating member 110.

Therefore, in the process of continuously printing a plurality of papers, the ribs 130*a* move in the first and second directions repeatedly by the paper-in, the fuser-in, and the fuser-out signals transmitted to the controller 8 by the sensor 9, the intervals between the front end and the middle portion of the paper with the heating member 110 are adjusted, and wrinkles and image smear on the paper are prevented simultaneously.

Hereinbelow, with reference to FIGS. 6 to 8, the fusing device according to another example of the disclosure will be described.

However, a fusing device 20 according to another example of the disclosure is different from the fusing device 10 according to an example in terms of the first and second guide members, and the first and second guide members will be described and the same configurations will not be described.

Figure 6:
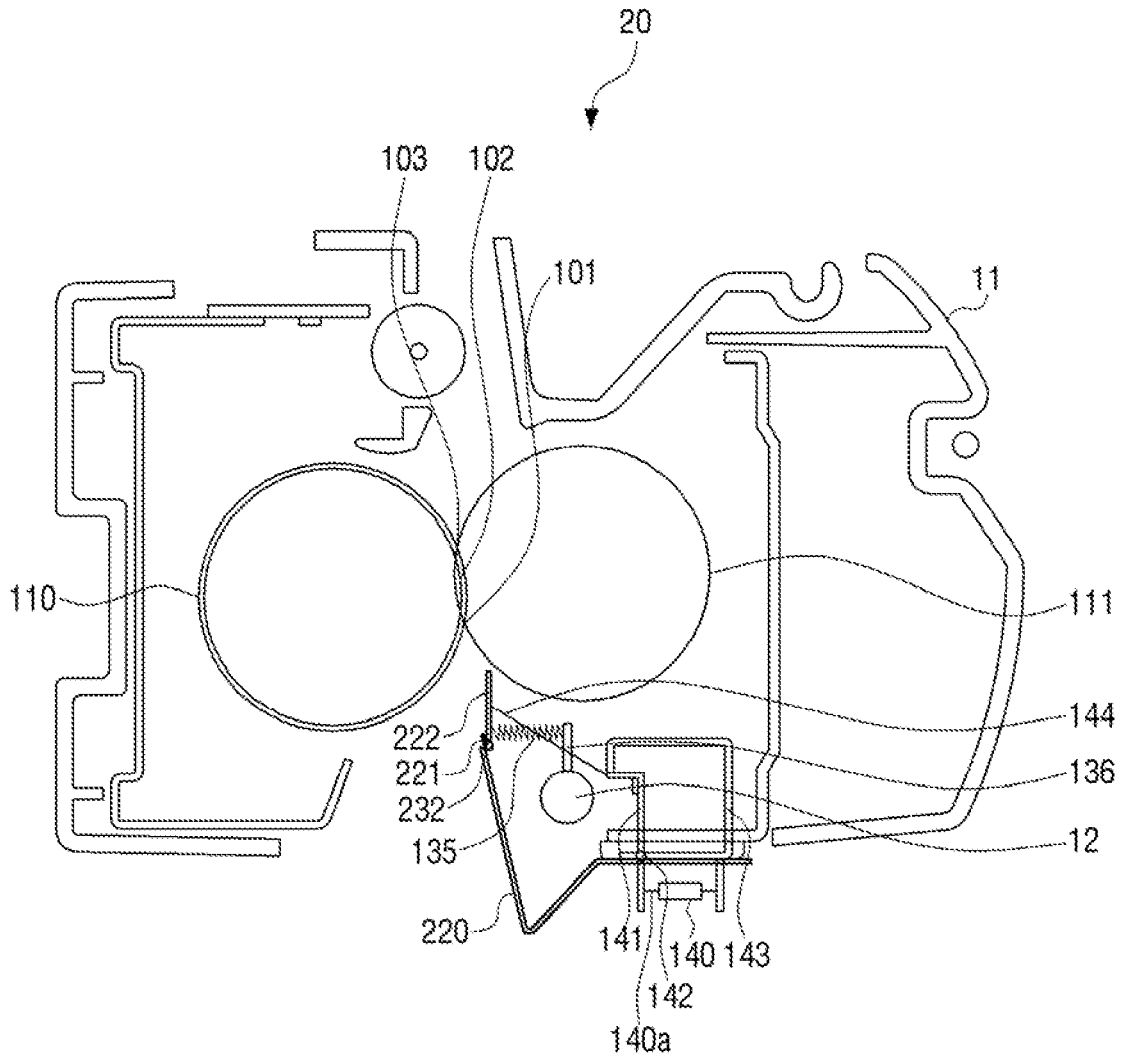
FIG. 6 is a sectional view illustrating an image forming apparatus including a fusing device according to another example of the disclosure.
Figure 7A:
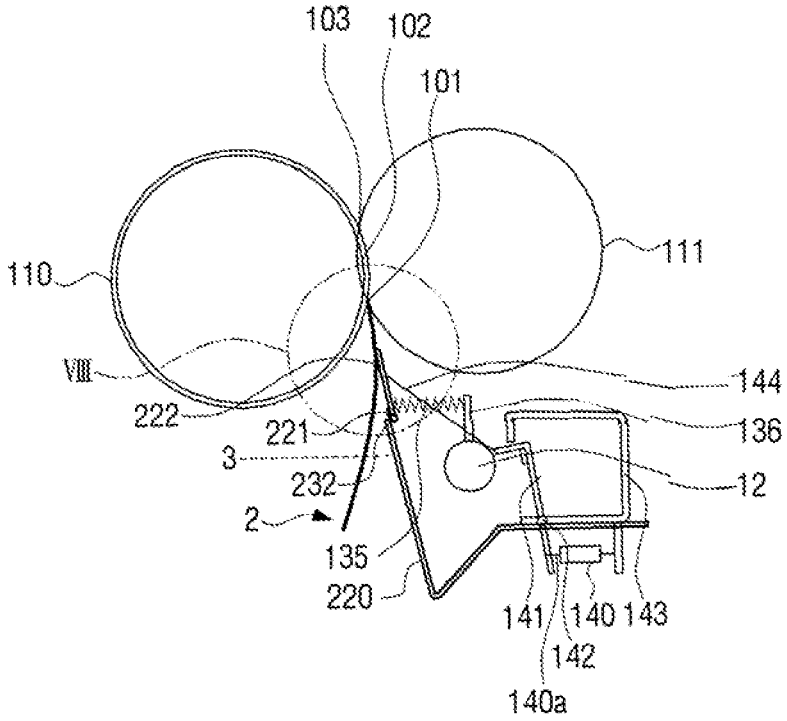
FIGS. 7A and 7B are sectional views illustrating an operating state of a fusing device according to another example of the disclosure.
Figure 7B:
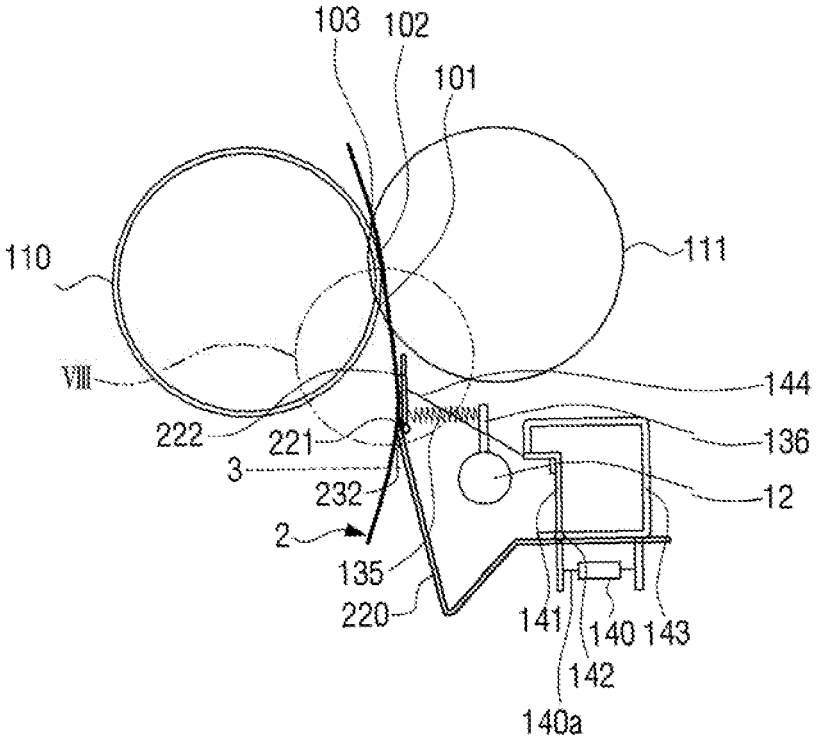

FIG. 6 is a sectional view illustrating an image forming apparatus including a fusing device 20 according to another example of the disclosure, FIGS. 7A and 7B are sectional views illustrating an operating state of the fusing device 20 according to another example of the disclosure, FIG. 8 is a sectional view enlarging VIII part of FIG. 7, illustrating intervals between the front ends of the first and second guide members and the heating member.

As illustrated in FIG. 5, the fusing device 20 is provided inside the housing 11 of the image forming apparatus 1.

In the fusing device 20 according to another example of the disclosure, the rear end of the second guide member 222 is hingeably connected to the front end of the first guide member 220 by the hinge element 232.

The second guide member 222 of the example of the disclosure is rotatably disposed in a clockwise direction or counterclockwise direction at the front end of the first guide member 220.

The second guide member 222 may be made of a metal plate having the same material as the first guide member 120, but is not limited thereto.

Also, when the second guide member 222 is in contact with the paper to guide the paper, it is necessary to minimize contacted cross sectional areas to reduce frictional resistance, and a groove may be formed at the front end of the second guide member 222.

At this time, the groove may be formed to have a comb shape which is similar to the groove 120*a* formed on the front end of the first guide member 120 according to an example of the disclosure.

The first guide member 220 according to another example of the disclosure may have a shorter length than the first guide member 120 according to an example of the disclosure. The first guide member 220 may be disposed to be farther away from the nip entrance 101.

The stopper 221 for limiting the rotation range of the second guide member 222 may be disposed at the front end of the first guide member 220. However, when the angle at which the lever 141 may be rotated is limited according to the movable range of the solenoid 140 constituting the actuator, the rotation range of the second guide member 222 connected by the lever 141 and the connecting member 144 is limited as well. In this case, the stopper 221 may not be provided at the front end of the first guide member 220.

Referring to FIGS. 7A, 7B, 8A and 8B, the front end of the first guide member 220 may be disposed between the first position and the second position. The second guide member 222 may protrude to the first position to prevent the wrinkles of the paper from being generated and when the paper 2 passes through the nip entrance 101, the second guide member 222 retreats to the second position to minimize the occurrence of image smear on the paper.

In this case, the front end of the first guide member 220 guides the paper to the nip entrance 101. Therefore, the front end of the first guide member 220 may be disposed between the first position and the second position to minimize the image smear on the paper.

The front end of the stopper 221 may be disposed to be farther away from the heating member 110 than the front end of the first guide member 220, and is disposed to be closer to the heating member 110 than the second guide member 222.

Figure 8A:
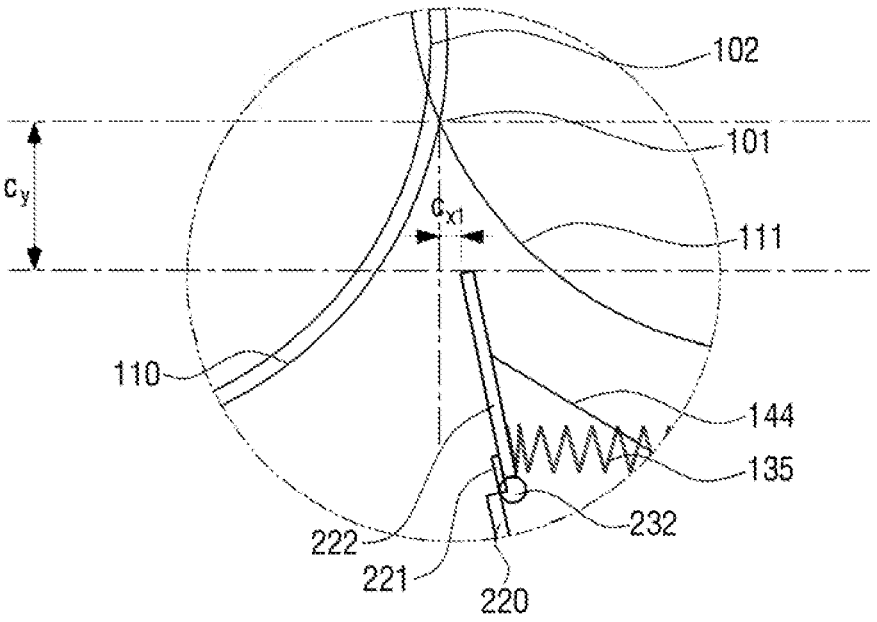
FIGS. 8A and 8B are sectional views enlarging VIII part of FIGS. 7A and 7B.
Figure 8B:
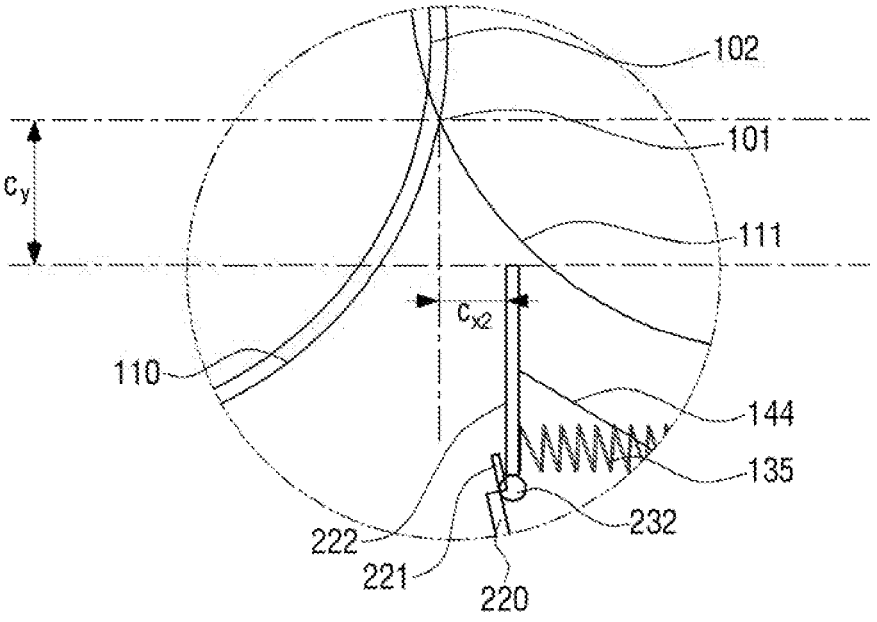

Referring to FIGS. 8A and 8B, the distance between the front end of the second guide member 222 to the nip entrance 101 may be defined as Cy.

When the second guide member moves to the second position, the paper is guided to the nip 102 by the front end of the first guide member 220. Here, the distance between the front end of the first guide member 220 and the nip entrance 101 is farther than Cy.

Therefore, the front end of the stopper 221 may be formed to extend from the front end of the first guide member 220, and the front end of the stopper 221 is spaced apart from the heating member 110 farther than the front end of the first guide member 220 so as not to cause image smear on the paper 2.

Also, since the front end of the stopper 221 is moved farther away from the heating member 110 than the front end of the first guide member 220, the paper 2, which is fed along the front end of the first guide member 220, is guided by the front end of the stopper 221 naturally, without paper jam.

Referring to FIG. 8A, the maximum horizontal displacement value at the first position which is the position where the front end of the second guide member 222 is as close as possible to the heating member 110 may be defined as $Cx_1$, and the minimum vertical displacement value which the nip entrance 101 and the front end of the first guide member 120 may form may be defined as Cy.

Referring to FIG. 8B, the maximum horizontal displacement value in the case where the front end of the second guide member 222 is disposed apart from the heating member 110 as much as possible may be defined as $Cx_2$.

$Cx_1$ and $Cx_2$ may have the same value, and the $Cx_1$ value may be set within the range of $0<Cx_1<2$ mm.

The Cy value may be defined as 2 mm<Cy<14 mm.

The second guide member 222 rotates within the horizontal and vertical displacement values as described above and guides the front end of the paper to the tangential direction of the heating member 110 so that wrinkles do not occur on the paper 2 nip entrance 101. When the front end of the paper passes through the nip entrance 101 and then advances to the nip 102, the paper 2 is moved away from the heating member 110 in order to prevent the occurrence of image smear.

According to another example of the disclosure, the rotation range of the second guide member 222 is wider than the rotation range of the second guide member according to an example of the disclosure.

In particular, when the second guide member 222 is rotated to the second position, the second guide member may be spaced apart from the heating member 110 as much as $Cx_2$, and the image smear may be restrained as much as possible.

The second guide member 222 according to another example of the disclosure may be spaced apart from the heating member 110 as much as possible, when rotating to the second position, image smear can be prevented to the maximum.

The coil spring 135 which is an elastic member may be disposed on the second guide member 222 and the coil spring 135 may be fixed on the second guide member 222 through an adhesive or the like. However, the example is not limited thereto, and it is sufficient if the coil spring 135 is fixed on the second guide member 222.

The second guide member 222 is connected to one end of the lever 141 through the connecting member 144 and is driven using the solenoid 140 connected to the other end of the lever 141 through the operating portion 140*a* and the coil spring 135. In addition, the sensor 9 which detects the positions of the front end and the rear end of the paper and the controller 8 control the solenoid 140.

A method of driving the second guide member 222 according to another example is the same as the driving method of the second guide member 130 according to an example of the disclosure and will not be described.

Hereinbelow, a fusing device according to still another example of the disclosure will be described with reference to FIGS. 9 to 12.

Figure 9A:
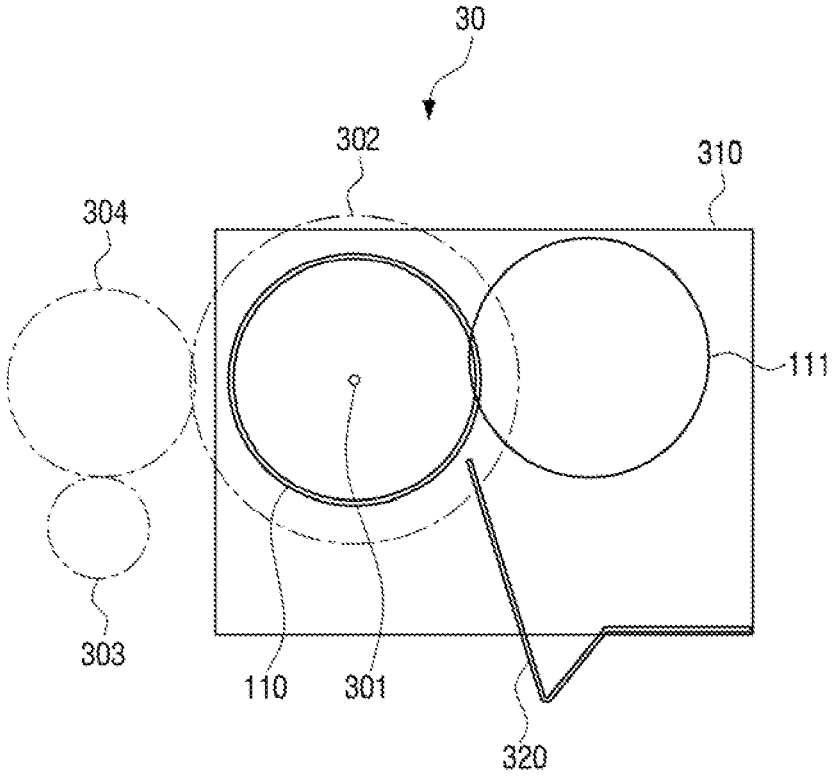
FIGS. 9A and 9B are schematic views describing the driving of a fusing device according to another example of the disclosure.
Figure 9B:
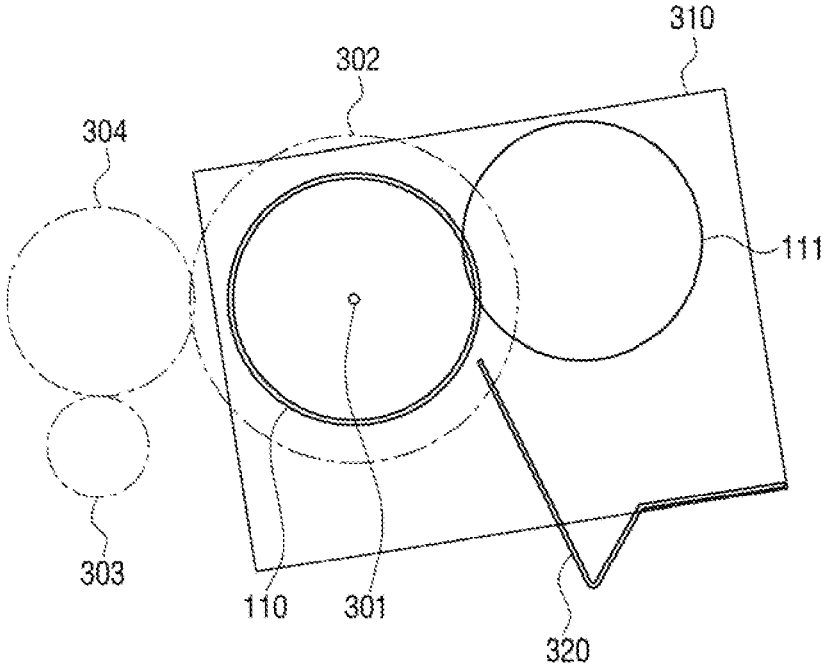
Figure 10:
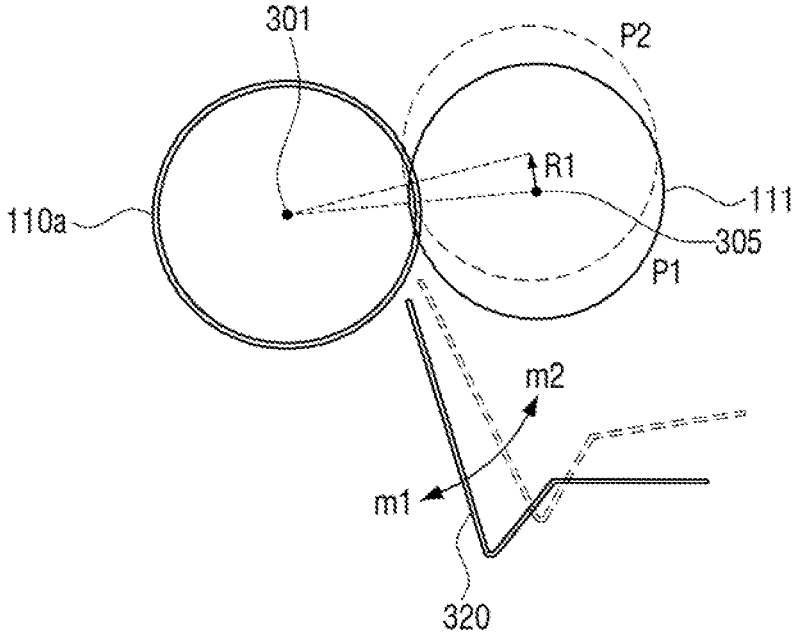
FIG. 10 is a view illustrating a driving state of a roller-type fusing device according to another example of the disclosure.
Figure 11:
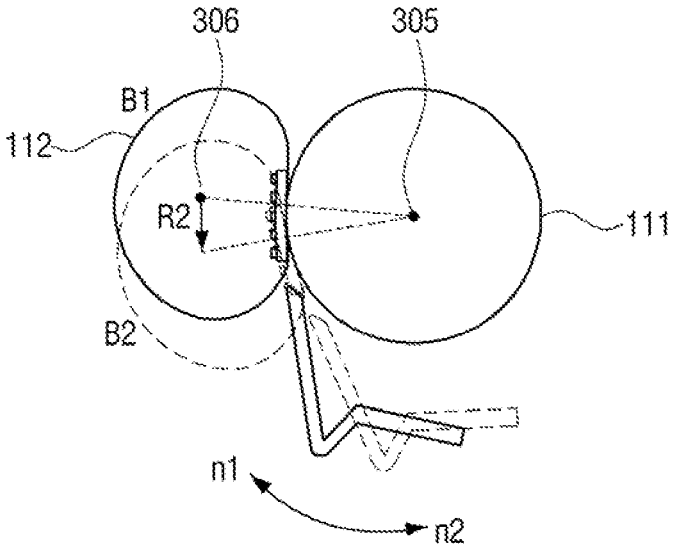
FIG. 11 is a view illustrating a driving state of a belt-type fusing device according to another example of the disclosure.

FIGS. 9A and 9B are schematic views describing the driving of a fusing device 30 according to another example of the disclosure, FIG. 10 is a view illustrating a driving state of a roller-type fusing device according to another example of the disclosure, FIGS. 11 and 12 are views illustrating a driving state of a belt-type fusing device according to another example of the disclosure.

Referring to FIGS. 9A and 9B, a fusing device 30 according to still another example of the disclosure may include a rotational body 310 which is rotatable about the rotational axis 301, 305 of the pressing member 111 or the heating member, a guide member 320 fixed to the rotational body 310, a first driving gear 302 connected to the pressing member 111 or the heating member 110, a reduction gear 304 engaged with the first driving gear 302, and a second driving gear 303 connected to the reduction gear 304.

The rotational body 310 is rotatable with respect to the rotational axis 301, and the rotational axis 301 of the rotational body is formed identical to the rotational axis 301 and 305 of the heating member 110 or the pressing member 111.

For example, when the rotational axis of the heating member 110 is formed to be identical to the rotational axis 301 of the rotational body 310, the pressing member 111 is fixed to the rotational body 310 to rotate along with the rotational body.

The rotational body 310 rotates around the rotational axis 301 or 305 of the pressing member 111 or the heating member 110 so as to change the relative distance between the guide member 320 fixed to the rotational body and the heating member 110.

The rotational body 310 is configured to repeatedly move between two predetermined positions while rotating in a clockwise direction and a counterclockwise direction.

A position in which the guide member 320 is closer to the heating member 110 while the rotational body 310 rotates in a clockwise direction and a counterclockwise direction is defined as the first position.

In contrast, a position in which the guide member 320 moves away from the heating member 110 while the rotational body 310 rotates in a clockwise direction and a counterclockwise direction is defined as the second position.

When the front end of the paper enters the nip entrance 101, the rotational body 310 moves to the first position to prevent the paper 2 from being wrinkled, so that the front end of the paper may be close to the tangential direction of the pressing member 111. When the front end of the paper passes through the nip entrance 101 and then directs toward the nip 102, the rotational body 310 is moved to the second position to prevent image smear on the paper 2 so that the paper moves far away from the heating member 110.

In the example of FIGS. 9A and 9B, it is illustrated that the rotational axis 301 of the rotational body is formed to be identical to the rotational axis of the heating member 110, driving of the rotational body 310 will be described in a greater detail, with this as an example.

When the sensor 9 detects that the front end of the paper passes through the transfer device 6 or reaches the position 3 before entering the nip entrance 101, the sensor 9 transmits the paper-in signal to the controller 8, and the controller 8 drives the second driving gear 303 to move the rotational body 310 to the first position.

The diameter of the second driving gear 303 is smaller than the diameter of the reduction gear 304 and the first driving gear 302. However, the power generated by the rotation of the second driving gear 303 is transmitted to the first driving gear 302 through the reduction gear 304. Therefore, since the first driving gear 302 may be driven with the power capable of driving the second driving gear 303, power consumption may be minimized.

When power of the second driving gear 303 is transmitted to the first driving gear 302 through the reduction gear 304, the first driving gear 302 rotates and moves the rotational body 310 to the first position.

The guide member 320 fixedly installed to the rotational body 310 rotates together with the rotational body 310 and moves to the first position. At this time, the relative distance between the heating member 110 and the guide member 320 is closer to each other.

The paper 2 moves closer to the tangential direction of the heating member 110 and a time difference in which the paper contacts the nip entrance 101 rarely occurs and wrinkles may be prevented from occurring in the paper 2.

When the sensor 9 detects that the front end of the paper passes through the nip entrance 101 or enters the nip 102, the sensor 9 transmits a fuser-in signal to the controller 8. The controller 8 drives the second driving gear 303 to move the rotational body 310 to the second position.

At this time, the controller 8 drives the second driving gear 303 for reverse rotation.

While rotating reversely, the second driving gear 303 transmits power to the reduction gear 304, and the power is again transmitted to the first driving gear 302. The first driving gear 302 causes the rotational body 310 to reversely rotate and moves the rotational body 310 to the second position.

The guide member 320 fixed to the rotational body 310 reversely rotates along with the rotational body 310 and moves to the second position. At this time, the relative distance between the heating member 110 and the guide member 320 gets away.

As the paper 2 moves away from the heating member 110, and the toner unfused onto the paper is not melt by heat of the heating member 110, image smear on the paper 2 may be prevented from occurring.

And when the rear end of the paper passes through the nip 102 or the nip outlet 103, the sensor 9 senses this and transmits the fuser-out signal to the controller 8.

The controller 8 receiving the fuser-out signal controls the first and second driving gears 302 and 303 to move the rotational body 310 to the first position, so that the front end of the paper following paper which passed through ahead may be close as possible to the tangential direction of the heating member 110.

Thus, in the process of continuously printing a plurality of papers, the rotational body 310 repeatedly moves between the first position and the second position by the paper-in, the fuser-in, and the fuser-out signals transmitted to the controller 8 by the sensor 9, and the interval between the front end and the middle portion of the paper with the heating member 110 is adjusted, and wrinkles and image smear on the paper are prevented at the same time.

Referring to FIG. 10, a fusing device 30 according to still another example may be in a type of a roller.

In FIG. 10, it is described that the rotational body 310 has the same rotational axis as the rotational axis 301 of the heating member 110, and the rotational body 310, the first and second driving gears 302 and 303, and the reduction gear 304 are not illustrated for description of an operational state.

In the example of the disclosure, the heating member 110 is formed as a heating roller 110*a*.

A rotational body (not shown) may rotate on a first position P1 and a second position P2 in directions of m1 and m2, with respect to the rotational axis 301 which is the same as the rotational axis 301 of the heating roller 110*a*.

At this time, the center 305 of the pressing member 111 is moved by the arc R1, and the guide member 320 fixed to the rotational body also rotates in the direction of m1 to m2, and the relative distance with respect to the heating member 110 is changed.

That the controller 8 controls the first and second driving gears 302 and 303 and the reduction gear 304 to drive the rotational body 310 is the same as the fusing device 30 according to still another example of the disclosure and this has been already described above. Therefore, further description will be omitted.

Referring to FIGS. 11 and 12, the fusing device 30 according to another example of the disclosure may be configured as a belt type. The rotating body 310, the first and second driving gears 302 and 303, and the reduction gear 304 are omitted from the drawing for description of the operating state of a belt-type fusing device.

In the example of the disclosure, it is described that the rotating body (not shown) has the same rotational axis as the rotational axis 305 of the pressing member 111.

And the heating member 110 may be configured as a belt 112.

On the belt 112, a nip forming unit 113 is formed to form the nip 102 in contact with the pressing member 111.

And on the nip forming unit 113, a heating unit 114 is disposed so as to melt toner which is unfused on the paper by heat so that the toner well permeates into the paper.

The rotational body rotates between the first position B1 and the second position B2 in a direction of n1 and a direction of n2 with respect to the rotational axis 305 of the pressing member 111.

At this time, the center 306 of the belt 112 is moved by the arc R2, and the guide member 320 fixed to the rotational body also rotates in the direction of n1 to n2, and the relative distance to the heating member 110 is changed.

Referring to FIG. 12, a virtual line formed by the nip entrance 101 and the front end of the guide member 320 is defined as C.

Figure 12A:
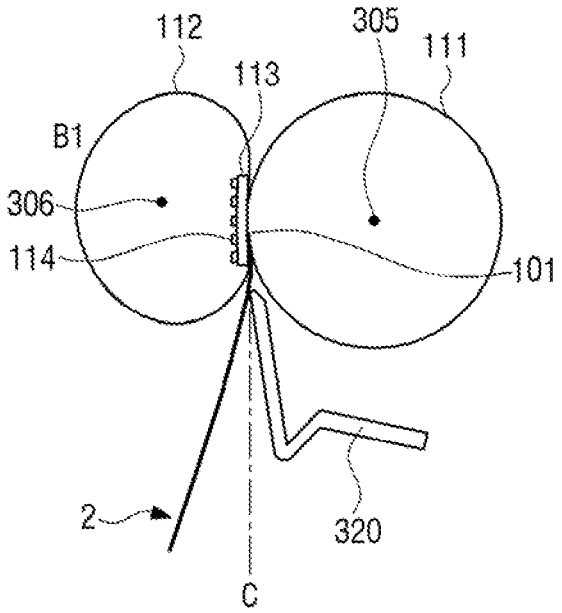
FIGS. 12A and 12B are views illustrating a driving state of a belt-type fusing device according to another example of the disclosure.

As described in FIG. 12A, when a rotational body (not shown) having the same rotational axis as the rotational axis 305 of the pressing member 111 is positioned at the first position B1, the front end of the guide member 320 is in contact with the virtual line C.

Therefore, the front end of the paper gets close to the tangential direction of the belt 112 as much as possible, while entering the nip entrance 101. Accordingly, wrinkles are prevented from occurring on the paper.

Figure 12B:
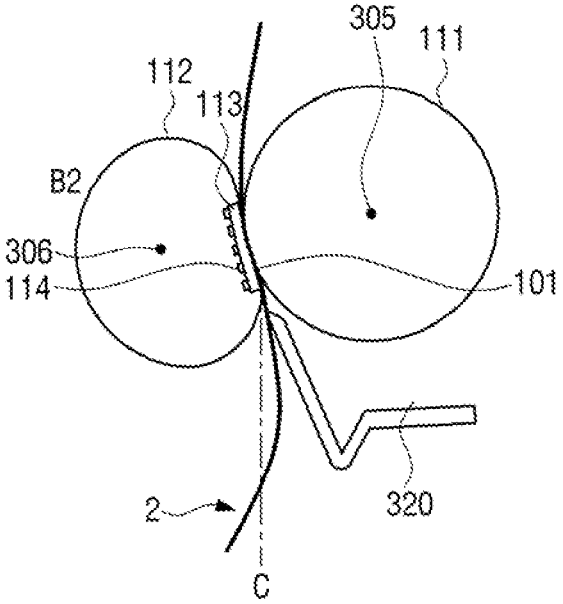

Referring to FIG. 12B, after the front end of the paper passes through the nip entrance 101, a rotational body (not shown) rotates around the rotational axis 305 of the pressing member 111 and moves to a second position B2.

At this time, the front end of the guide member 320 is moved away from the virtual line C, and the paper 2 is moved away from the heating unit 114 installed on the nip forming unit 113 of the belt 112.

By the foregoing, the phenomenon that the toner not fused on the paper is melt by the heating unit 114 will not be occurring, and image smear will be prevented.

That the controller 8 controls the first and second driving gears 302 and 303 and the reduction gear 304 to drive the rotational body 310 is the same as the fusing device 30 according to another example of the disclosure and has already been described above, so further description is omitted here.

The fusing device 30 according to another example of the disclosure is configured such that the rotational body 310 is rotatable about the rotational axis 301 or 305 of the pressing member 111 or the heating member 110 as a central axis, and the guide member 320 is fixed to the rotational body 310 and rotates together with the rotational body 310 so as to change a relative distance with the heating member 110. Therefore, the structure is simple compared to the fusing device 10 according to an example of the disclosure.

While the disclosure has been shown and described with reference to certain examples thereof, it will be understood by those skilled in the art that various changes in form and details may be made therein without departing from the spirit and scope of the disclosure as defined by the appended claims. Therefore, the scope of the disclosure is defined not by the detailed description of the disclosure but by the appended claims, and all differences within the scope will be construed as being included in the disclosure.

What is claimed is:

1. A fusing device comprising:

a heating member;

a pressing member to press a recording medium against the heating member;

a first guide member to guide the recording medium to a nip formed between the heating member and the pressing member;

a second guide member to pass through the first guide member and to be hingeably connected to the first guide member, the second guide member is to move to a first position before a front end of the recording medium enters the nip, and is to move to a second position after the front end of the recording medium enters the nip; and an actuator to move the second guide member to the first position and the second position, the second guide member being further away from the heating member at the second position than at the first position.

2. The fusing device of claim 1, wherein the front end of the first guide member includes a plurality of grooves, and the second guide member includes a plurality of ribs to pass through the plurality of grooves.

3. The fusing device of claim 2, wherein the plurality of ribs are parallel to each other at regular intervals in a width direction of the recording medium.

4. The fusing device of claim 1, further comprising:

a stopper on at least one of the first guide member and the second guide member to limit a rotation range of the second guide member.

5. The fusing device of claim 1, further comprising an elastic member to elastically support the second guide member from the second position to the first position.

6. The fusing device of claim 1, wherein the actuator comprises:

at least one lever;

a connecting member to connect the second guide member and a first end of the at least one lever; and a solenoid to connect to a second end of the lever and rotate the lever.

7. The fusing device of claim 6, further comprising:

a support frame to which the at least one lever is hingeably connected and the solenoid is mountable.

8. The fusing device of claim 1, comprising:

a sensor to detect a position of a front end and a rear end of the recording medium; and a controller to control driving of the actuator according to a position of the recording medium detected by the sensor, wherein the controller is to control the actuator so that the second guide member moves to the first position before the front end of the recording medium enters the nip, and is to control the actuator so that the second guide member moves to the second position after the front end of the recording medium enters the nip.

9. The fusing device of claim 1, wherein a rear end of the second guide member is hingeably connected to a front end of the first guide member.

10. The fusing device of claim 9, wherein a front end of the first guide member is disposed between the first position and the second position.

11. The fusing device of claim 9, further comprising:

a stopper fixed to a front end of the first guide member and is disposed to be farther from the heating member than the front end of the first guide member and is disposed to be closer to the heating member than the second position.

12. An image forming apparatus comprising:

a main body;

a photosensitive medium on which an electrostatic latent image is formed;

a developing device to develop the electrostatic latent image of the photosensitive medium by a developing agent;

a transfer device to transfer the developed image of the photosensitive medium on a recording medium; and a heating member to fuse the developed image transferred on the recording medium, and a fusing device to press the recording medium while facing the heating member, wherein the fusing device further comprises:

a first guide member;

a second guide member to pass through the first guide member and to be hingeably connected to the first guide member, the second guide member is to move to a first position before a front end of the recording medium enters the nip, and is to move to a second position after the front end of the recording medium enters the nip; and an actuator to move the second guide member to the first position and the second position, the second guide member being further away from the heating member at the second position than at the first position.

13. The image forming apparatus of claim 12, wherein the front end of the first guide member includes a plurality of grooves, and the second guide member includes a plurality of ribs to pass through the plurality of grooves.

14. A fusing device comprising:

a rotational body to rotate around a pressing member or a heating member;

a guide member fixed to the rotational body;

a first driving gear to connect to a rotational axis of the heating member or the pressing member to rotate the rotational body;

a reduction gear to engage with the first driving gear;

a second driving gear to transmit power to the reduction gear;

a sensor to detect a position of a front end and a rear end of a recording medium; and a controller to control driving of the second driving gear according to a position of the recording medium detected by the sensor, wherein the guide member is to move to a first position and a second position, the guide member being further away from the heating member at the second position than at the first position, according to rotation of the rotational body in a clockwise direction or a counterclockwise direction.

15. The fusing device of claim 14, wherein the controller is to control the second driving gear to move the guide member to the first position before a front end of the recording medium enters the nip, and is to control the second driving gear to move the guide member to the second position after a front end of the recording medium enters the nip.

* * * * *